US005277427A

United States Patent [19]

Bryan et al.

[11] Patent Number: 5,277,427

[45] Date of Patent: Jan. 11, 1994

[54] GOLF TRAINING CLUB

[76] Inventors: Robert M. Bryan, 4469 Vieux Carre Cir., Tampa, Fla. 33613; Geroge A. Potter, 1 Highbury Cresent, Camberley, Surrey, GUI51J2, England

[21] Appl. No.: 890,013

[22] Filed: May 27, 1992 (Under 37 CFR 1.47)

[51] Int. Cl.[5] ..... A63B 69/36

[52] U.S. Cl. ..... 273/186.2; 273/193 B; 403/157; 403/161; 403/158

[58] Field of Search ..... 273/193, 193 B, 81.3, 193 R, 193 A, 186.2, 187.4

[56] References Cited

U.S. PATENT DOCUMENTS 4,854,585 8/1989 Koch et al. ..... 273/193 B 5,195,748 3/1993 Koch et al. ..... 273/193 B X

*Primary Examiner*—George J. Marlo

*Attorney, Agent, or Firm*—Herbert W. Larson

[57] ABSTRACT

The club has a hinge interposed on a shaft between the hand grip and club head, the hinge allowing the shaft to articulate about thirty degrees in both a front and back direction from the longitudinal axis of the shaft. The hinge has a female and male member. The female member is in the form of a yoke with a bore at the end of each yoke side arm. The male member has a body portion through which a bore passes and which is axially aligned with the bores of the yoke side arms. A pivot pin passes through these bores to provide the pivot point of the hinge. A U-shaped spring is attached to the female member interior to the yoke side arms. A ball bearing in a projecting nose of the male member rotates along the interior side arms of the spring. The ends of the female member side arms have pairs of oppositely directed ramps providing a stop along an outer shelf on each side of the male member body portion.

7 Claims, 4 Drawing Sheets

GOLF TRAINING CLUB

BACKGROUND OF THE INVENTION

1. Field of The Invention

This invention relates to golf training clubs. More particularly, it refers to an improved hinge for a golf training club permitting the shaft of the club to articulate from the normal longitudinal axis of a standard golf club.

2. Description of The Prior Art

Golf swing training devices of many different designs are well known in the prior art. Many of the prior art golf training clubs have hinges allowing a portion of the club to swing or articulate in a single direction. Examples of this prior art is seen in U.S. Pat. Nos. 2,497,237 and 3,033,575. U.S. Pat. No. 4,854,585 describes a two-way hinge mechanism. This latter patent employs a hinge activated by a longitudinally extending coil spring located within a generally hollow cylindrical portion. A spherical member at one end of the spring is urged towards a cavity between a pair of yoke arms. The hinge allows the shaft of the golf club to articulate front and back up to ninety degrees. Such a golf training club has drawbacks in causing the articulation of the hinge to be unnecessarily large at ninety degrees so that a golfer could be thrown off balance. Furthermore, the hinge mechanism is difficult to maintain in good operating condition. Improvements on this golf training club is needed.

SUMMARY OF THE INVENTION

We have invented a golf training club that articulates front and back no more than thirty degrees and has simple moving parts that are easy to maintain and are free from recurrent mechanical failure.

Our hinge device has female and male members. The female member has the mechanical form of a yoke with two oppositely facing parallel side arms. A transverse bore is located at an end portion of each side arm.

The male member has a body portion through which a transverse bore passes and which is axially aligned with the bore of the female member side arms. A pivot pin passes through each of the bores to provide the pivot point of the hinge. The male member has a projecting nose portion inserted between the side arms of the female member. A hardened ball bearing is located in an aperture in an end portion of the projecting nose. A U-shaped spring including side arms is screwed to a base of the female member between its two side arms. The ball bearing rotates along interior side edges of the spring side arms. A pair of set screws situated in bores on the female member side arms adjust the tension on the spring side arms. The hinge allows the break of the golf club at about thirty degrees front and back from a longitudinal axis of the club. The ends of the female member side arms have pairs of oppositely directed ramps providing a stop along an outer shelf on each side of the male member body portion.

BRIEF DESCRIPTION OF THE DRAWINGS

The invention may be best understood by those having ordinary skill in golf training clubs by reference to the following detailed description when considered in conjunction with the accompanying drawings in which.

DETAILED DESCRIPTION OF THE INVENTION

Figure 1:
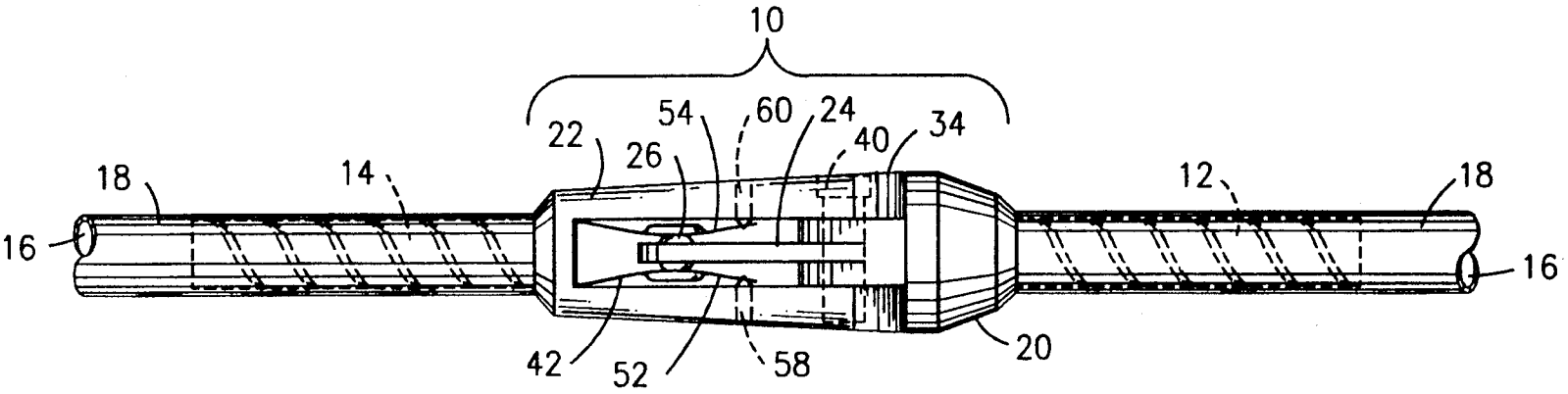
FIG. 1 is a longitudinal side view of the hinge mechanism attached to a golf shaft with spring set screws and a pivot pin in phantom.
Figure 2:
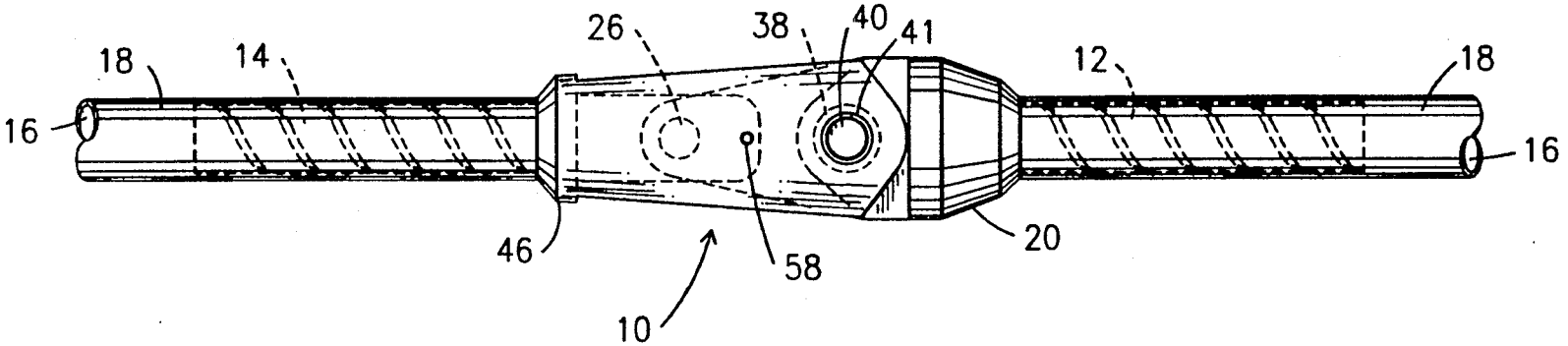
FIG. 2 is a longitudinal top plan view of the hinge mechanism with the components of the hinge in phantom.
Figure 3:
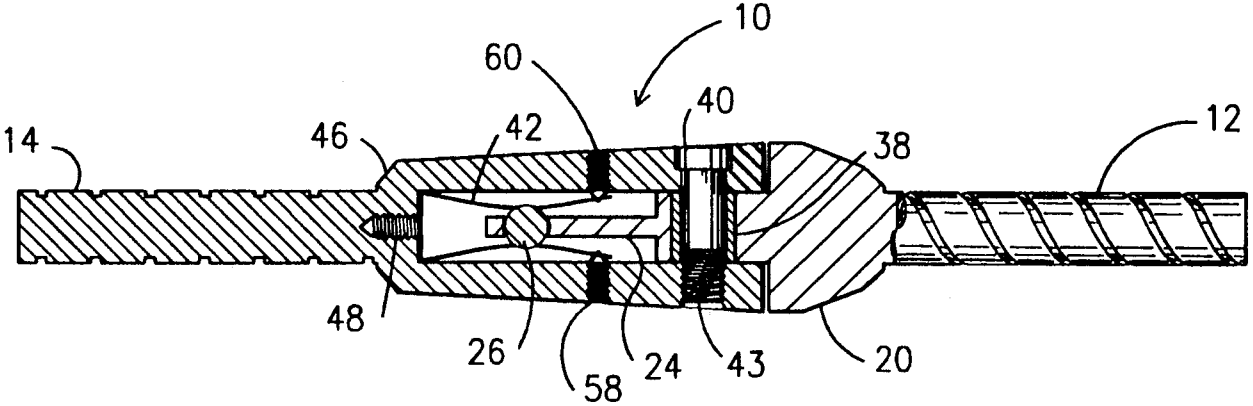
FIG. 3 is a side section view through the hinge mechanism.
Figure 4:
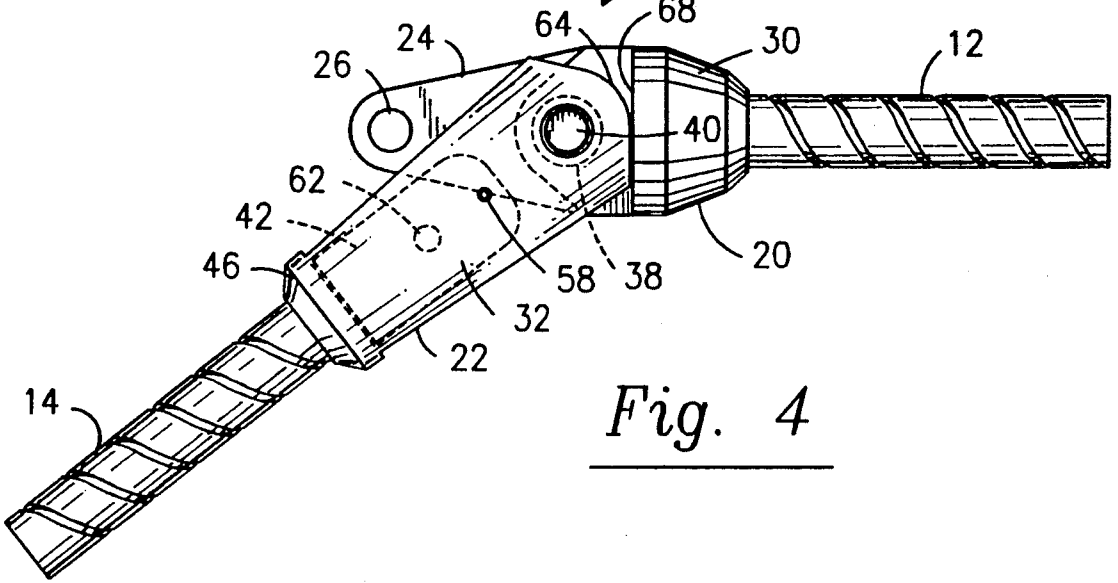
FIG. 4 is a side view of the hinge mechanism disengaged from a longitudinal axis at about a thirty degree angle.

Throughout the following detailed description, the same reference numerals refer to the same elements in all figures.

The golf club hinge mechanism 10 shown in FIG. 1 has an integral first mounting rod 12 and second mounting rod 14. The mounting rods 12 and 14 are inserted within the hollow core 16 of a golf shaft 18 that has been transversely cut across its longitudinal axis. Each of rods 12 and 14 are glued in place within the hollow core 16 of club shaft 18.

Figure 5:
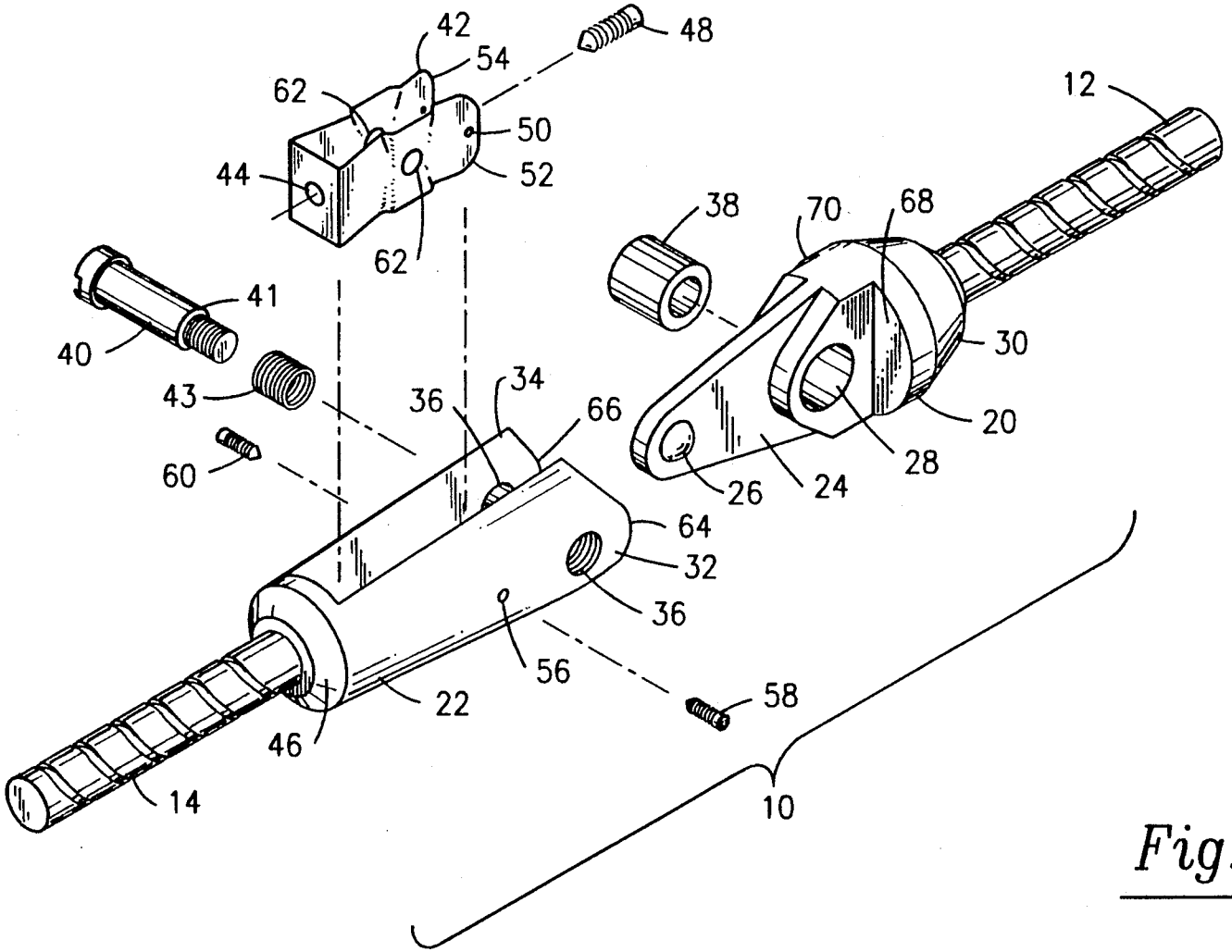
FIG. 5 is an exploded view of the hinge mechanism.

As seen in FIG. 5, the hinge mechanism has a male member 20 and a female member 22. The male member has a projecting nose portion 24 with a ball bearing 26 located within the end of nose 24. A bore 28 passes through about the mid-point of the male member 20. The base housing 30 of the male member 20 is integral with rod 12.

The female member 22 is in the form of a yoke having side arms 32 and 34. Each side arm has a bore 36 which is axially aligned with bore 28 in the male member 24. One of the bores can contain screw threads as seen in FIG. 5. A bearing 38 is inserted through the bore 28 and then a pivot pin 40 axially connects the bores in the female member 36 to the bore 28 in the male member 24. Threads at the end of pin 40 engage with the interior of coil 43 mounted within the threaded bore 36. A shoulder 41 on pin 40 acts as a stop to prevent pin 40 from pulling side arms 32 and 34 towards each other.

A U-shaped spring 42 is screwed through hole 44 to the base portion 46 of the female member 22. Screw 48 is used to mount spring 42 in place. Small holes 62 on each side arm 52 and 54, respectively of spring 42 engage and hold the ball bearing 26 from the male member 24 when it is inserted between the yokes of the female member 22. The ball bearing disengages from the spring 42 when the golf club is improperly swung. The spring 42 is preferably coated with a film of polytetrafluroethylene.

The various members of the hinge 10 are manufactured from a high quality stainless steel. The ball bearing 26 located at the end of nose portion 24 of male member 22, is approximately five millimeters in diameter and is held in a rotatable position between the holes 62 in spring 42. The spring 42 is made out of spring steel. Set screws 58 and 60 are used to tension spring 42 after repeated opening and closing of the hinge. The set screws engage holes 50 in each spring arm 52 and 54, respectively.

Generally, the ball bearing 26 is retained in its normal position engaged to the spring 42 to a pre-set pressure of about fourteen pounds per square inch. Above this pressure, the spring pressure is overcome and allows the hinge to pivot around pin 40. The spring 42 can be replaced by merely unscrewing screw 48 after taking the hinge apart by removing pin 40.

The ends of the female member 64 and 66 respectively, as seen in FIG. 5, have radii engaging sides 68 and 70 of the male member 20. The radii ends 64 and 66 allow the hinge to pivot to about thirty degrees.

Figure 6:
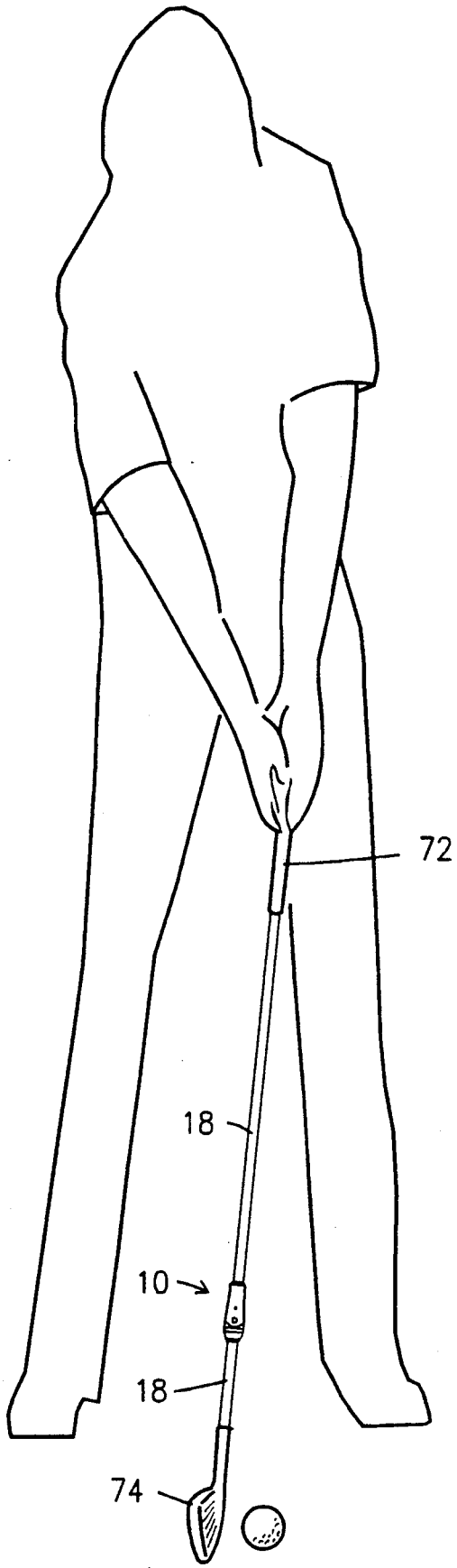
FIG. 6 is a perspective view of a golfer holding a golf club containing the hinge mechanism.

The positioning of the hinge 10 at the correct location within the shaft 18, as shown in FIG. 6 between grip portion 72 and head portion 74 provides a perfectly balanced club. If the club is incorrectly swung, the hinge pivots providing the user or teacher with an immediate indication of a fault at that point of the swing enabling the fault to be corrected. If the swing and timing are correct, the hinge remains unhinged thereby enabling the user to hit a regular golf ball. The training club provides the user with a training device which when swung in accordance with the instructions, will enable both the inexperienced and scratch golfers to correct their swing pattern.

Having thus described the invention, what is claimed and desired to be secured by Letters Patent is:

1. A golf training club having a hinge mechanism separating a grip and club head portion of a hollow golf club shaft, the hinge mechanism comprising:

(a) a female member having the form of a yoke with two oppositely facing side arms forming a cavity between the side arms, a first end portion of each side arm having a transverse bore, a second end portion of the side arms attached to a female member base integral with a first mounting rod extending away from the side arms along a longitudinal axis between the side arms, (b) a male member having a male member base with a second mounting rod extending away from the male member along the longitudinal axis of the first mounting rod, a nose portion integral with the male member base extending from the male member base in an opposite direction from the second mounting rod, a hardened ball bearing mounted in an aperture in an end of the nose portion distal from the male member base, a transverse bore in the male member between the ball bearing and male member base, (c) a U-shaped spring mounted within the cavity in the female member, a base portion of the U-shaped spring attached to the female member base, a pair of side arms of the U-shaped spring being in a plane substantially parallel to the female member side arms, (d) the ball bearing in the nose portion of the male member mounted to engage an inside edge of each spring side arm, (e) an alignment device passing through the transverse bores of each female member side arm and the transverse bore of the male member to axially align the female and male members together, (f) the first and second mounting rods permanently mounted within the hollow golf club shaft to join the grip and head portions of the golf club shaft, the hinge maintaining the golf club shaft in a contiguous longitudinal axis when the golf club is properly swung, but causing the ball bearing to disengage from the spring and cause the club shaft to articulate when the club is swung improperly.

2. A golf training club according to claim 1 wherein one transverse bore of the female member side arms is threaded to engage threads at one end of the alignment device.

3. A golf training club according to claim 2 wherein the alignment device is a pivot pin.

4. A golf training club according to claim 1 wherein the side arms of the U-shaped spring each has a transverse bore for seating the hardened ball bearing when the grip and head portions of the shaft are aligned.

5. A golf training club according to claim 1 wherein the ball bearing is offset from the U-shaped spring upon exertion of more than fourteen pounds of pressure on the hinge.

6. A golf training club according to claim 1 wherein a set screw is mounted transversely on a side of each female member side arm and exerts tension on a side arm of the U-shaped spring.

7. A golf training club according to claim 1 wherein a bushing is mounted within the transverse bore in the male member and the alignment device passes through the bushing.

* * * * *